US005806836A

United States Patent [19]

Wilson

[11] Patent Number: 5,806,836

[45] Date of Patent: Sep. 15, 1998

[54] TRACK JACK APPARATUS

[76] Inventor: Brian M. Wilson, 2371 Arbordale Drive, Mississauga, Ontario, Canada, L58 2M8

[21] Appl. No.: 775,152

[22] Filed: Dec. 31, 1996

[51] Int. Cl.[6] ..... B66F 3/00

[52] U.S. Cl. ..... 254/133 R

[58] Field of Search ..... 248/354.7, 354.6, 248/352, 409; 254/133 R, 134, DIG. 1

[56] References Cited

U.S. PATENT DOCUMENTS

| | | | |
|---|---|---|---|
| 2,882,012 | 4/1959 | Luna | 254/133 R |
| 3,178,146 | 4/1965 | Goodale | 248/352 |
| 3,599,923 | 8/1971 | Hunnicutt | 248/352 |
| 3,834,669 | 9/1974 | Reid | 254/133 R |
| 4,066,243 | 1/1978 | Johnson | 254/133 R |
| 4,479,634 | 10/1984 | Blatz | 254/133 R |
| 4,540,147 | 9/1985 | Lincourt | 248/352 |
| 5,180,131 | 1/1993 | Few | 254/108 |

*Primary Examiner*—Robert C. Watson

[57] ABSTRACT

A track jack apparatus including a base portion that has an upper surface with a socket portion. The socket has an aperture therethrough. Also, a lifting mechanism that has a body portion is included. The body portion has a handle with a component that has a pair of J-hook members that extend therefrom. The body portion has a ratchet mechanism contained within. Included is a rigid rod that has a bottom end positioned within the socket portion; a rear wall that has a plurality of angular notches; and a top end that receives the body portion of the lift mechanism. Lastly, the body portion is positioned adjacent the socket portion and next to a coupling of a snowmobile. Positioning the body portion next to the coupling allows the J-hook members of the handle to engage the coupling and apply a lifting force when the ratchet mechanism is engaged.

2 Claims, 3 Drawing Sheets

TRACK JACK APPARATUS

BACKGROUND OF THE INVENTION

1. Field of the Invention

The present invention relates to a track jack apparatus and more particularly pertains to allowing the rear end of a snowmobile or similar vehicle to be lifted from a receiver surface with a manually operated lifting mechanism for storage or maintenance.

2. Description of the Prior Art

The use of jack lifts is known in the prior art. More specifically, jack lifts heretofore devised and utilized for the purpose of lifting snowmobiles are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,145,154 to Bastille and Vaillancourt discloses a self-contained power assist lift jack. U.S. Pat. No. 5,143,352 to Latimer discloses a snowmobile lift apparatus. U.S. Pat. No. 5,135,200 to Neibrandt discloses a snowmobile jack. U.S. Pat. No. 3,964,729 to Harlow discloses an elevating device for snowmobiles. U.S. Pat. No. 3,860,078 to Stoick discloses a snowmobile support valley. Lastly, U.S. Pat. No. 3,734,466 to Mason discloses a lift device for variably displaying and facilitating repairs of vehicles such as snowmobiles.

While these devices fulfill their respective, particular objectives and requirements, the aforementioned patents do not describe track jack apparatus that allows a lift mechanism with a ratchet mechanism to move the body portion of the invention upward for lifting of the rear end of a snowmobile, but not allowing the ratchet mechanism to move downward to provide additional safety when the snowmobile is above a receiving surface.

In this respect, the track jack apparatus according to the present invention substantially departs from the conventional concepts and designs of the prior art, and in doing so provides an apparatus primarily developed for the purpose of allowing the rear end of a snowmobile or similar vehicle to be lifted from a receiver surface with a manually operated lifting mechanism for storage or maintenance.

Therefore, it can be appreciated that there exists a continuing need for a new and improved track jack apparatus which can be used for allowing the rear end of a snowmobile or similar vehicle to be lifted from a receiver surface with a manually operated lifting mechanism for storage or maintenance. In this regard, the present invention substantially fulfills this need.

SUMMARY OF THE INVENTION

In view of the foregoing disadvantages inherent in the known types of jacks now present in the prior art, the present invention provides an improved track jack apparatus. As such, the general purpose of the present invention, which will be described subsequently in greater detail, is to provide a new and improved track jack apparatus and method which has all the advantages of the prior art and none of the disadvantages.

To attain this, the present invention essentially comprises a generally rectangular base portion. The base portion has an upper surface and a rear surface. The upper surface of the base portion has a generally rectangular socket portion that extends upwardly. The socket has an aperture through a pair of parallel sides of the socket. The rear surface is positioned on a receiving surface. Also, included is a lifting mechanism that has a generally rectangular body portion. The body portion has a handle member that extends outwardly from a front side. The handle member has a horizontal component with a first end and a second end that are proportionately spaced one from another. Each end of the horizontal component has a rigid J-hook member that is integral thereto and extends downwardly. The body portion has a ratchet mechanism contained within. The ratchet mechanism has a ratchet handle with an internal end and an external end that extends from a rear side of the body. The internal end of the ratchet handle engages a helical spring that is housed within the body portion. The spring is adjacent the internal end and the rear side of the body. The body portion further has a pair of balancing rods with each rod extending outwardly from a side of the body. A rigid wall is provided. The rigid wall has a front wall, a rear wall, and a pair of side walls therebetween. The rod has a length of about three feet and a diameter that allows it to be positioned within the socket portion of the base. The rear wall of the rod has a plurality of angular notches that are positioned along the length of the rod. The rod is capable of receiving the body portion of the lift mechanism over a top end of the rod. The top end of the rod is opposite the socket portion of the base. The internal end of the handle of the body is capable of biasing toward the spring when the body is positioned over the rod. The internal end of the handle engages the notches of the rod. Lastly, the body portion is positioned on the rod and adjacent the socket portion for placement next to a coupling of a snowmobile. The body portion, when placed next to the coupling of the snowmobile, allows the J-hook members of the handle to engage the coupling. The external end of the handle is capable of having an external force placed thereon to create a ratcheting motion between the internal end and the notches of the rod to operate the lift mechanism. The external force is exerted against the external end and causes the body portion to traverse the rod in a upward direction while the J-hook member apply a lifting force to the coupling.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved track jack apparatus which has all of the advantages of the prior art jacks and none of the disadvantages.

It is another object of the present invention to provide a new and improved track jack apparatus which may be easily and efficiently manufactured and marketed.

It is further object of the present invention to provide a new and improved track jack apparatus which is of durable and reliable constructions.

An even further object of the present invention is to provide a new and improved track jack apparatus which is susceptible of a low cost of manufacture with regard to both materials and labor, and which accordingly is then susceptible of low prices of sale to the consuming public, thereby making such track jack apparatus economically available to the buying public.

Still yet another object of the present invention is to provide a new and improved track jack apparatus which provides in the apparatuses and methods of the prior art some of the advantages thereof, while simultaneously overcoming some of the disadvantages normally associated therewith.

Even still another object of the present invention is to provide a track jack apparatus for allowing the rear end of a snowmobile or similar vehicle to be lifted from a receiver surface with a manually operated lifting mechanism for storage or maintenance.

Lastly, it is an object of the present invention to provide a new and improved track jack apparatus including a base portion that has an upper surface with a socket portion. The socket has an aperture therethrough. Also, a lifting mechanism that has a body portion is included. The body portion has a handle with a component that has a pair of J hook members that extend therefrom. The body portion has a ratchet mechanism contained within. Included is a rigid rod that has a bottom end positioned within the socket portion; a rear wall that has a plurality of angular notches; and a top end that receives the body portion of the lift mechanism. Lastly, the body portion is positioned adjacent the socket portion and next to a coupling of a snowmobile. Positioning the body portion next to the coupling allows the J hook members of the handle to engage the coupling and apply a lifting force when the ratchet mechanism is engaged.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
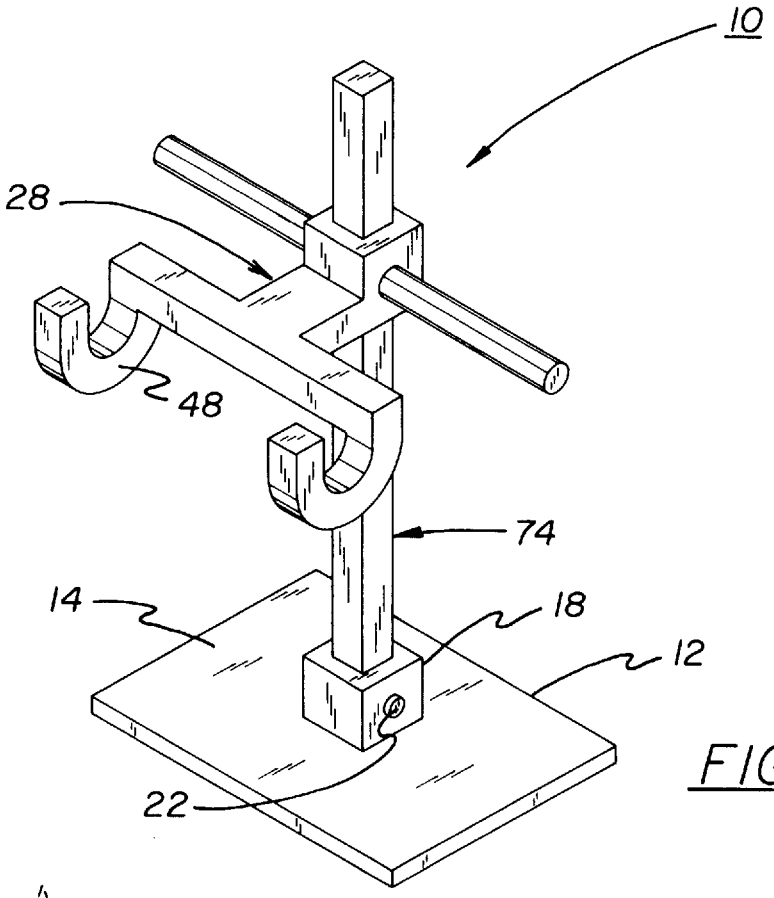
FIG. 1 is an isometric view of the preferred embodiment of the track jack apparatus constructed in accordance with the principles of the present invention.

With reference now to the drawings, and in particular to FIG. 1 thereof, the preferred embodiment of the new and improved track jack apparatus embodying the principles and concepts of the present invention and generally designated by the reference numeral 10 will be described.

The present invention, the track jack apparatus 10 is comprised of a plurality of components. Such components in their broadest context include a base, a lifting mechanism, and a rod. Such components are individually configured and correlated with respect to each other so as to attain the desired objective.

Specifically, the present invention includes a generally rectangular base portion 12. The base portion is formed of a rigid metal or metal alloy. Preferably, the base portion is made of steel. The base portion has an upper surface 14 and a rear surface 16. As shown in FIG. 1, the upper surface of the base portion has a generally rectangular socket portion 18 that extends upwardly. The socket portion has an aperture 22 that is positioned through a pair of parallel sides 24 of the socket portion. The rear surface of the base is positioned on a receiving surface. The receiving surface should be a flat surface.

Figure 2:
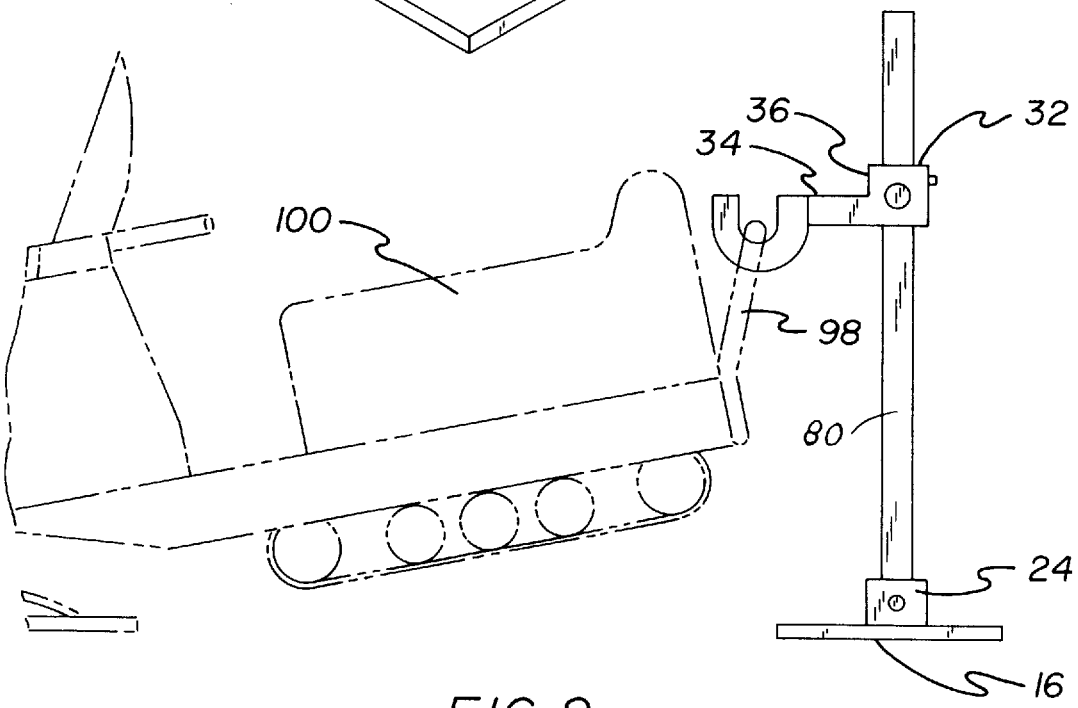
FIG. 2 is a side view of the present invention in a operable configuration.
Figure 3:
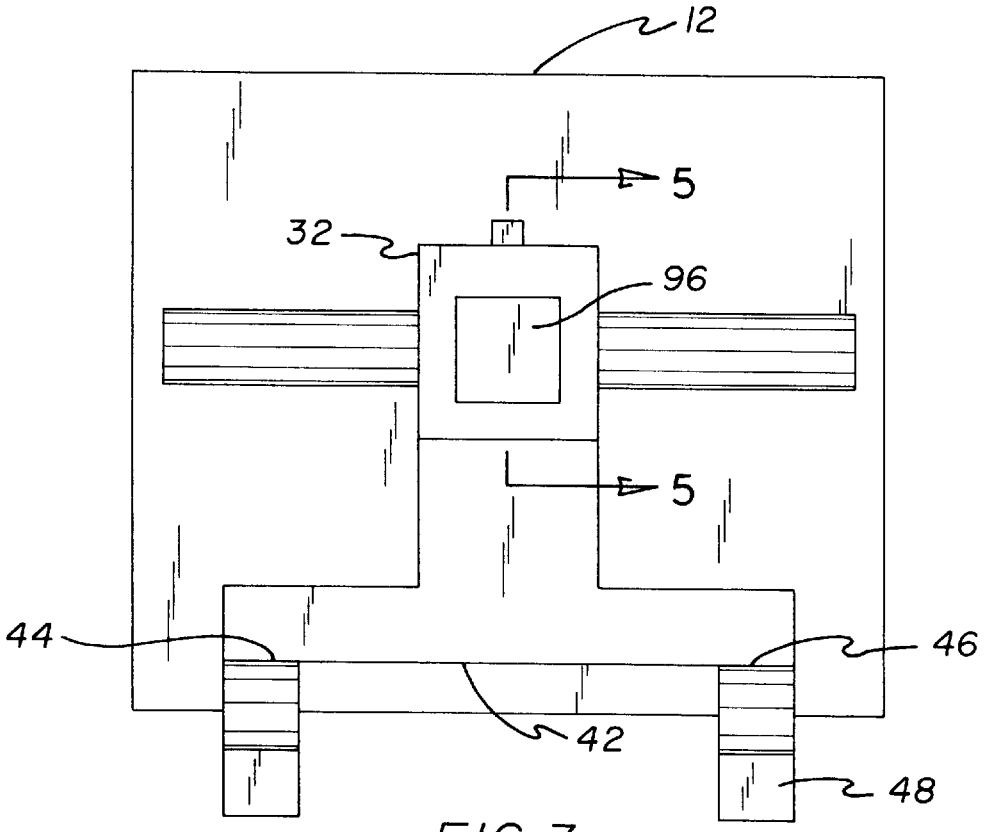
FIG. 3 is a top plan view of the present invention.

As best illustrated in FIG. 1, a lifting mechanism 28 is provided. The lifting mechanism is formed of the same rigid steel used to form the base. The lifting mechanism has a generally rectangular body portion 32 with a handle member 34 that extends outwardly from a front side 36, as shown in FIG. 2. The handle member has a horizontal component 42 that has a first end 44 and a second end 46. The ends of the horizontal component are proportionately spaced one from another, as illustrated in FIG. 3. Each end of the horizontal component has a rigid J-hook member 48 that is integral the ends. Each J-hook member extends downwardly from the ends of the handle.

Figure 5:
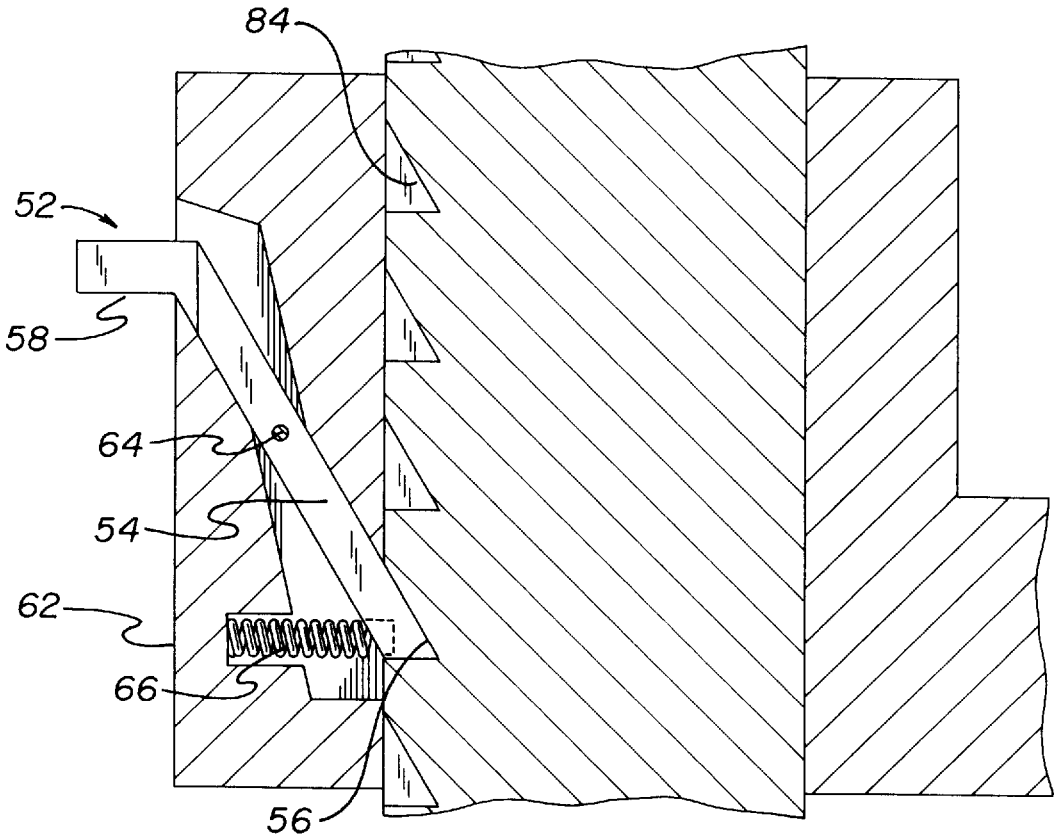
FIG. 5 is cross sectional view taken along line 5—5 of FIG. 3.

The body portion 32 has a ratchet mechanism 52 contained within. The ratchet mechanism is comprised of a ratchet handle 54 that has an internal end 56 and an external end 58 that extends from a rear side 62 of the body. As best illustrated in FIG. 5, the ratchet handle is held within the body portion with a pivot pin 64. The internal end of the ratchet handle engages a helical spring 66 that is housing within the body portion and adjacent the internal end 56. The spring has a high bias strength. The body portion further, has a pair of balancing rods 70. The balancing rods, as shown in FIG. 3, extends outwardly from a side 72 of the body for balancing and stability when the lifting mechanism in operation.

Figure 4:
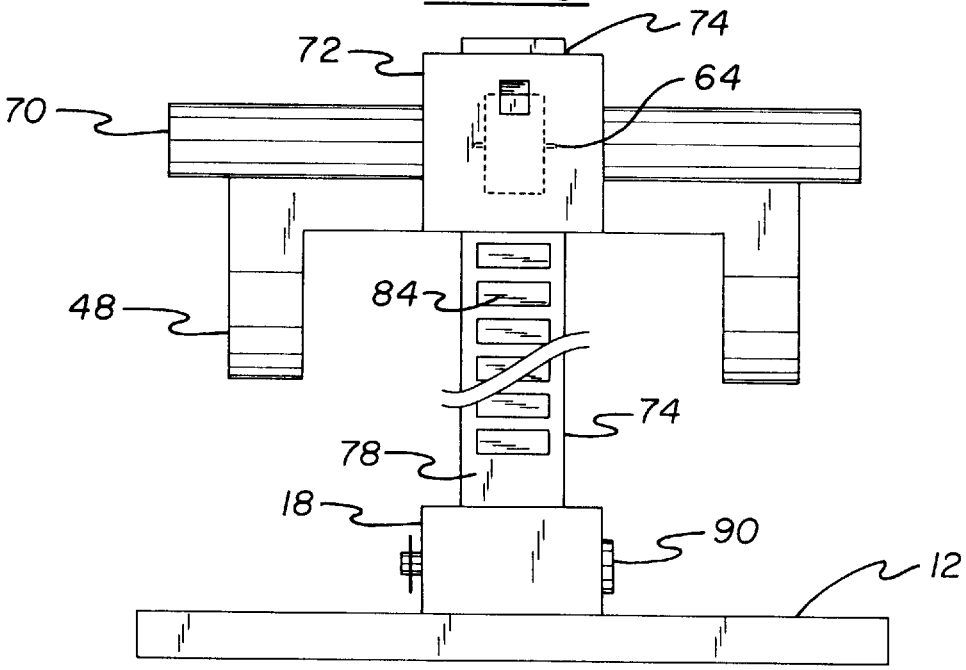
FIG. 4 is a rear view of the present invention as shown in FIG. 3.
Figure 6:
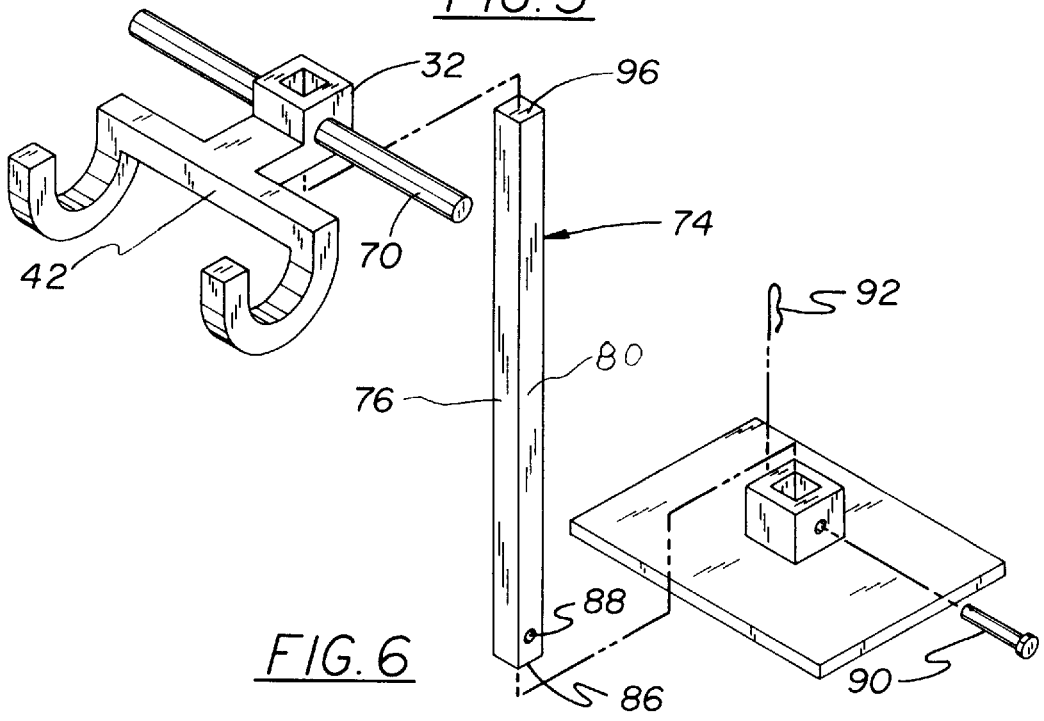
FIG. 6 is an exploded view of the present invention depicting the operable components.

Also, included is a rigid rod 74. The rod, as shown in FIG. 6, is a solid metal or metal alloy, The rod has a front wall 76, a rear wall 78, and a pair of side walls 80. The rod has a length of about three feet and a diameter for positioning within the socket portion 18 of the base 12. The rear wall of the rod has a plurality of angular notches 84, as shown in FIG. 4, that are positioned along the rod's length. The rod has a bottom end 86 with an opening 88 near the bottom end.

As illustrated in FIG. 4, when the rod is positioned within the socket, a locking pin 90 is placed through the aperture 22 and the opening. The locking pin is held in placed by a clamp 92. The rod receives the body portion of the lift mechanism over a top end 96 of the rod. The top end of the rod is positioned opposite the socket portion 18 of the base.

The internal end 56 of the handle 54 of the body is capable of biasing toward the spring 66 when the body is positioned over the rod. The internal end of the handle is capable of engaging the notches of the rod when the locking mechanism is in place around the rod.

Lastly, the body portion 32 is placed around the rod and slid down the rod to be adjacent the socket portion. The body portion of the locking mechanism is then placed next to a coupling 98 of a snowmobile 100, as shown in FIG. 2. The body portion of the locking mechanism, is then placed next to the coupling of the snowmobile to allows the J-hook members 48 of the handle 34 to engage the coupling.

Furthermore, the external end 58 of the ratchet handle 54 receives an external force for creation of a ratcheting motion between the internal end 56 and the notches 84 of the rod. The ratcheting motion provides the operable component for the lift mechanism 28. The external force is a manual force that is provided by the track jack user. The force exerted against the external end will cause the body portion to traverse the rod in a upwardly direction, while the J-hook members apply a lifting force to the coupling. The lift mechanism traverses the rod with the ratcheting motion to position the snowmobile at a desired height. Once the snowmobile is lifted above the receiving surface and reaches the desired height, it is locked in place by the force of the spring on the internal end.

The present invention is track jack apparatus for lifting a snowmobile and light vehicles. The present invention is comprised of a base, a lift mechanism, and a rigid rod. The base of the track jack apparatus has a socket portion for receiving a rod. The rod extends vertically upward away from the base and has positioned around it a lifting mechanism. The lifting mechanism allows the snowmobile to be hoisted above the ground for storage during the off season or for maintenance. The lifting mechanism of the present invention has a ratchet-type lift that will move upwardly along the length of the rod. Once the snowmobile has been lifted up the lifting mechanism is locked in positioned and can not be let back down using the same ratcheting motion. The J-hook member of the locking mechanism are spaced about six inches apart along the horizontal component of the handle. Spacing of the J-hook members allows the balance of the track jack apparatus to be maintained when being engaged to lift the snowmobile. The locking mechanism of the present invention is a manual mechanism that allows you to lift the rear end of the snowmobile without any other assistance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved track jack apparatus for lifting of snowmobiles and like vehicles comprising in combination:

a generally rectangular base portion having an upper surface and a rear surface, the upper surface of the base portion having a generally rectangular socket portion extending upwardly therefrom, the socket having an aperture positioned through a pair of parallel sides of the socket portion, the rear surface capable of being positioned on a receiving surface;

a lifting mechanism having a generally rectangular body portion with a handle member extending outwardly from a front side of the body portion, the handle member having a horizontal component with a first end and a second end proportionately spaced one from another, each end of the horizontal component having a rigid J-hook member integral thereto and extending downwardly therefrom;

the body portion having a ratchet mechanism contained therein, the ratchet mechanism comprising a ratchet handle having an internal end and an external end extending from a rear side of the body, the internal end of the ratchet handle being capable of engaging a helical spring being housed within the body portion adjacent the internal end, the body portion further having a pair of balancing rods with each rod extending outwardly from a side of the body;

a rigid rod having a front wall, a rear wall and a pair of side walls therebetween, the rod having a length of about 3 feet and a diameter for positioning within the socket portion of the base, the rear wall of the rod having a plurality of angular notches positioned along the length of the rod, the rod capable of receiving the body portion of the lift mechanism over a top end of the rod, the top end of the rod being opposite the socket portion of the base, the internal end of the handle of the body being capable of biasing toward the spring when the body being positioned over the rod, the internal end of the handle being capable of engaging the notches of the rod; and the body portion capable of being positioned on the rod and adjacent the socket portion for placement next to a coupling of a snowmobile, the body portion being placed next to the coupling of the snowmobile for allowing the J-hook members of the handle to engage the coupling, the external end of the ratchet handle being capable of receiving an external force for creation of a ratcheting motion between the internal end and the notches of the rod for operation of the lift mechanism, the external force being exerted against the external end and capable of causing the body portion to traverse the rod in an upwardly direction, while the J-hook members apply a lifting force to the coupling.

2. A track jack apparatus comprising:

a base portion having an upper surface with a socket portion extending therefrom with the socket having an aperture therethrough, the base portion having a rear surface being positioned on a receiving surface, and the socket portion of the upper surface having the aperture positioned through a pair of parallel sides thereof;

a lifting mechanism having a body portion with a handle member having a component, the component having a pair of J-hook members extending therefrom, the body portion having a ratchet mechanism contained therein, the component being horizontal with a first end and a second end proportionately spaced one from another and the J-hook members integral a respective end thereof;

the ratchet mechanism having a handle extending from a rear side of the body and capable of receiving an external force and engaging a helical spring being housed within the body portion;

a rigid rod having a bottom end for positioning within the socket portion of the base, a rear wall having a plurality of angular notches, and a top end for placing the body portion of the lift mechanism thereover, the rod extending vertically from the socket portion and having a front wall and a pair of side walls therebetween, the rear wall of the rod having a plurality of angular notches positioned along the length of the rod; and the body portion capable of being positioned adjacent the socket portion and next to a coupling of a snowmobile for allowing the J-hook members of the handle to engage the coupling and to apply a lifting force when the ratchet mechanism being engaged, the body portion having a pair of balancing rods with each rod extending outwardly from a side of the body, the balancing rod being capable of adding stability to the track jack apparatus.

* * * * *